United States Patent [19]

Schippers

[11] 3,962,829

[45] June 15, 1976

[54] MACHINES FOR TEXTURIZING SYNTHETIC POLYMER FILAMENTS

[75] Inventor: Heinz Schippers, Remscheid, Germany

[73] Assignee: Barmag Barmer Maschinenfabrik Aktiengesellschaft, Wuppertal, Germany

[22] Filed: Oct. 15, 1974

[21] Appl. No.: 514,470

[30] Foreign Application Priority Data

Oct. 17, 1973 Germany ..... 2352027

[52] U.S. Cl. ..... 57/34 HS

[51] Int. Cl.[2] ..... D01H 13/28

[58] Field of Search ..... 57/34 HS, 34 R, 157 R, 57/157 TS, 1; 242/35.5 R

[56] References Cited

UNITED STATES PATENTS

| | | | |
|---|---|---|---|
| 3,165,881 | 1/1965 | Moncuit et al. | 57/34 HS |
| 3,501,904 | 3/1970 | Batsch | 57/34 HS |
| 3,565,355 | 2/1971 | Schippers et al. | 242/35.5 R |
| 3,682,404 | 8/1972 | Busch | 242/35.5 R |
| 3,813,863 | 6/1974 | Ritter | 57/34 HS |

*Primary Examiner*—Donald E. Watkins

*Attorney, Agent, or Firm*—Johnston, Keil, Thompson & Shurtleff

[57] ABSTRACT

Machines for texturizing, especially crimping, synthetic polymer filaments such as yarns or threads, wherein the latter are treated between a first set of delivery rollers and a second set of delivery rollers in a first heating system and texturizing unit, and are delivered to a take-up unit, a second heating system and a third set of delivery rollers optionally being arranged between the second set of delivery rollers and the take-up unit, the texturizing machine being in the form of a three part machine frame with the three parts of the machine frame arranged parallel to one another, wherein the take-up units are arranged on the three parts of the machine frame.

10 Claims, 2 Drawing Figures

MACHINES FOR TEXTURIZING SYNTHETIC POLYMER FILAMENTS

Figure 1:
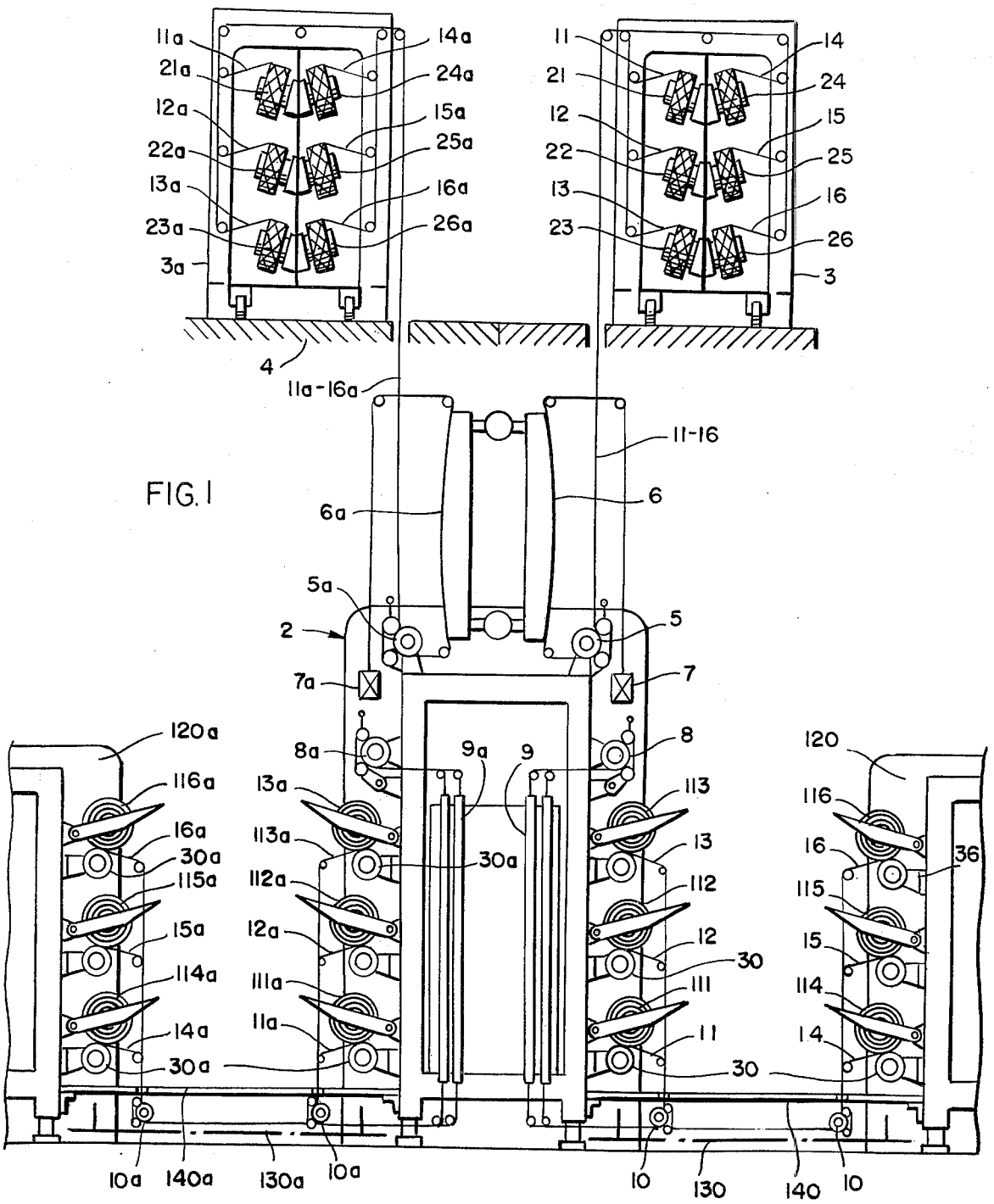

The invention is concerned with the problem of building in compact form texturizing machines of the kind described above. In the context of the invention, texturizing machines are false-twist crimping machines, separation twisting machines (cf. for example German Pat. No. 2,137,451), compression crimping machines (for example German Laid-Open Application No. 1,199,430), sprocket crimping machines (cf. for example U.S. Pat. No. 3,263,298), two-component crimping machines (for example British Pat. No. 950,429), machines in which filaments are asymmetrically treated throughout their cross-section, for example edge crimping machines (cf. for example U.S. Pat. No. 3,152,435) and machines in which filaments are asymmetrically heated throughout their cross-section. The synthetic polymer filaments can also be stretched on the texturizing machine before or during the texturizing treatment.

In texturizing machines, particular importance is attached to the heating systems. The heating systems not only have to be able to be set and regulated with precision to an exact ideal temperature, but also the temperatures have to be constant in terms of time and space. In terms of space, deviations in temperature occur above all in the directions of filament travel. It is known that the temperature profile of the heating system changes when a filament is guided over the heating system. Changes also occur when the rate of filament travel is changed (cf. for example Textil-Praxis 1960, pages 801 et seq). However, another extremely important factor in terms of space is that all the heating systems of one and the same texturizing machine should have the same temperatures and temperature profiles, so that uniform products can be obtained from all working positions with one and the same machine setting. Deviations in the temperature profiles of only one or a few working positions in a machine lead to a reduction in the quality of production as a whole.

It is easier to keep temperatures and temperature profiles constant in terms of space by making the heating systems as compact as possible, because in this way not only is it possible more effectively to avoid heat losses, local differences in temperature attributable to thermal conduction can also be more quickly corrected.

The possibilities for keeping the heating systems compact in structure in the direction of filament travel are limited because, at the high rates of filament travel currently required for economic operation, the necessary residence times of the filament in the heating system can only be guaranteed by making the heating systems correspondingly long in design.

Accordingly, where the requirement for compact construction applies above all to the longitudinal direction of the machine, this means that the heating systems are provided with as many filament runs as possible per unit length of the machine. This in turn means that the other functional components of each working position, such as the yarn delivery rollers, false-twisters and take-up units, also have to be able to handle a number of closely adjacent filaments. So far as the delivery rollers and texturizing units are concerned, this does not present any difficulties. So far as false-twist crimping machines are concerned, it is pointed out in particular that multispindle false-twisters are known (for example French Pat. No. 1,362,081), that several filaments can be simultaneously false-twisted in one spindle (for example German Published Application No. 2,063,127) and that there are also numerous friction false-twisters which are able to handle large numbers of closely adjacent filaments (for example U.S. Pat. No. 1,030,179).

It is also pointed out that the tape delivery systems in wide use today (cf. for example German Gbm. No. 1,896,021) are also readily capable of handling large numbers of closely adjacent filaments.

The same does not apply as regards the take-up units. The take-up spools have to be able for economic reasons to wind a certain minimum length of filament. In many cases, they also have to have certain dimensions, particularly in the longitudinal direction, for reasons of further processing. Accordingly, the take-up units cannot be designed to take up less space.

The problem of accommodating as many take-up units as possible in the machine is normally solved by arranging the take-up units in tiers one above the other. In addition, the need for a compact construction has repeatedly meant that certain units associated with each working position have to be separated from that part of the machine frame carrying the functional unit itself (referred to hereinafter as the first part of the machine frame). Thus, it is known that the take-off bobbins can be accommodated on a separate part of the machine frame (referred to hereinafter as the take-off bobbin creel), cf. for example German Pat. No. 1,785,466. It is also known that the take-up units can be accommodated on a separate part of the machine frame (referred to hereinafter as the second and third parts of the machine frame), cf. *Textile Manufacturers*, July 1973, pages 47 and 48). Finally, it is known that both take-off bobbins and take-up units can be accommodated not on the first part of the machine frame, but instead either on a common creel (cf. German Published Application No. 1,435,536) or even separately from one another on a separate take-off bobbin creel and a second and third part of the machine frame, cf. for example *Textile Manufacturers*, supra). Reference is also made to other solutions using the same principles in Melliand 1972, page 1085, Chemiefasern 1972, page 623 and German Pat. No. 1,435,355.

Accordingly, the known, fundamental principle for solving the problem of accommodating a large number of take-up units along the front of the machine, is to arrange the take-up units in tiers one above the other. It is clear that this solution could only realize limited success, irrespective of whether the take-up units are accommodated on the first part of the machine frame or on separate parts of the machine frame, namely the second and third parts, or on both sides of the first part of the machine frame, because the number of take-up units to be accommodated in tiers one above the other is similarly limited in both cases for reasons of machine servicing.

The object of the present invention is to accommodate more take-up units per unit length of the front of the machine than has hitherto been possible in texturizing machines of the kinds described above, without exceeding the optimum number of vertically adjacent tiers of take-up units in terms of machine servicing.

According to the invention, this object is achieved in a texturizing machine of the kind referred to above, in the form of a three-part machine frame with the three parts of the machine frame arranged parallel to one another, by arranging the take-up units on the three parts of the machine frame.

This solution may be used with advantage in conjunction with the earlier solution in which the take-up units are arranged in tiers one above the other. In this connection, the take-up units are with advantage distributed in an equal number of tiers among the component parts of the machine frame.

In another advantageous embodiment of the invention, the take-up units are driven at the same speed by mechanical, interlocking transmission systems.

One advantageous possibility of varying the number of filaments being processed is to arrange the take-up units on a plate designed in the form of a structural unit.

The particular advantage of this texturizing machine is that there is no need for the entire machine front to be serviced to be covered with take-up units. The take-up units are merely arranged up to a level which is favorable in terms of machine servicing and which allows both manual servicing and also servicing by means of automatic bobbin changers (cf. for example German Published Application No. 2,123,689). It is clear that the principle behind the solution proposed in accordance with the invention can also be applied with advantage to other filament processing machines comprising take-up units, such as for example two-for-one twisting machines, combined stretching and winding machines and combined spinning, stretching and winding machines.

Figure 2:
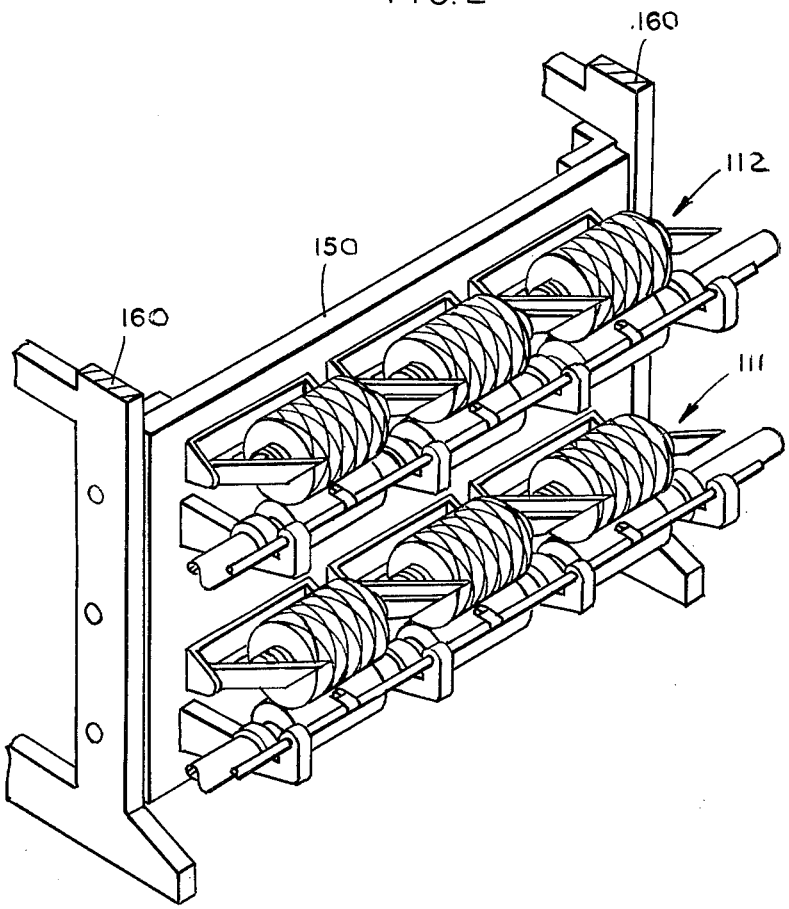

One exemplary embodiment of the invention is described in the following description, in conjunction with the drawings, wherein;

FIG. 1 is an end elevation of a false-twist crimping machine and its take-up units, and FIG. 2 is a perspective view of a segment of a take-up portion of a texturizing machine of the invention with the take-up bobbins in two tiers.

Referring to FIG. 1, the false-twist crimping machine consists of several machine-frame sections. The illustrated first part 2 of the machine frame carries the first delivery rollers 5, 5*a;* the first heating system 6, 6*a;* the false-twisters 7, 7*a;* the second delivery rollers 8, 8*a;* the second heating system 9, 9*a;* the third delivery rollers 10, 10*a;* and take-up units 111–116, 111*a*–116*a;* and the central drive (not visible). The delivery rollers 5, 8, 10 and 5*a*, 8*a*, 10*a* and their respective take-up units are interconnected by gear transmissions, so that different filament delivery speeds or rates of filament travel can be adjusted via the various delivery rollers.

In the embodiment illustrated, the take-off bobbin creels 3, 3*a* for the false-twist crimping machine are set up on a floor 4 above the main machine frame 2. They are mobile so that they can be moved into position already equipped with take-off bobbins. However, the take-off bobbin creels can also be arranged elsewhere on the main machine frame (cf. for example German Published Application 1,760,002). The take up units 111–116 handle the filaments 11 to 16 taken off the take-off bobbins 21 to 26 of the creel 3. The take-up units 111*a*–116*a* handle the filaments 11*a*–16*a* taken off the bobbins 21*a*–26*a* of the creel 3*a*. The filaments travel in the form of a tight bundle through the delivery rollers, the heating systems and the false-twister in the order mentioned above. It is pointed out that the second heating system 9, 9*a* can also be bypassed so that the filaments run onto the take-up units behind the false-twister. The false-twisters can be, for example, double-spindle units in each of which two spindles are present. Double-spindle false-twisters of this kind can be arranged closely adjacent one another in the longitudinal direction of the machine.

The take-up units 111 to 116 and 111*a* to 116*a* consist of drive rollers 30 and 30*a* by which the take-up spools are driven at their periphery. The drive rollers 30 and 30*a* are interconnected through synchronizing systems 130 and 130*a* which can be mechanical or electrical synchronizing systems. The take-up units 111, 112 and 113 and 111*a*, 112*a* and 113*a* are arranged on opposite sides of the first part 2 of the machine frame. The take-up units 114, 115 and 116 are arranged on the second part 120 of the machine frame. The third part 120*a* of the machine frame is identical with the second part 120 of the machine frame. The take-up units 114*a*, 115*a* and 116*a* are arranged on the second part 120*a* of the machine frame. The filaments 14, 15 and 16 and 14*a*, 15*a*, and 16*a* to be taken up are guided below the platforms 140, 140*a* in order to create and keep free a servicing aisle between the first part 2 of the machine frame and each of the second part 120 and third part 120*a* of the machine frame.

It has proved to be an advantage that the texturizing machine can readily be adapted to the number of filaments to be processed.

Accordingly, FIG. 2 shows a structural unit with preassembled winding units arranged in two tiers. The structural unit consists of a plate 150 to which the take-up units are fixed. Each plate 150 extends over one zone of the texturizing machine and is stiffened by ribs and transverse ribs. These structural units are themselves so strong that they are able to withstand the static and dynamic loads occurring, more especially vibration. Preassembled structural units of this kind allow not only the first part of the machine frame but also a second and third part of the machine frame to be quickly assembled without difficulty in cases where the number of filaments being processed in a texturizing machine already in operation has to be increased, with the result that the original number of take-up units arranged along the front of the machine is no longer sufficient.

FIG. 2 shows the supports 160 of the first or second and third parts of the machine frame between which the plate 150 is fixed.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. A textile machine for texturizing synthetic polymer filaments which comprises a first set of filament-delivery rollers, a second set of filament-delivery rollers, filament heating means and filament texturizing means in the filament path between said sets of rollers, first, second and third substantially parallel machine frame parts in horizontally spaced relationship, a plurality of filament take-up units for the bobbin-winding of the texturizing filaments arranged in sets on each of the three frame parts, said first frame part having mounted thereon said texturizing means, and said second and third frame parts having their respective take-up units opposite to and horizontally spaced from the take-up units on said first frame part.

2. A textile machine as claimed in claim 1, said machine having a third set of filament-delivery rollers in the filament path between the second set of rollers and the respective take-up units of the respective frame parts and also second filament heating means in the filament path between the second set of rollers and the respective sets of filament take-up units.

3. A textile machine as claimed in claim 1, wherein the respective sets of take-up units include driven winder units arranged in tiers of horizontal rows on each of said frame parts, and the number of said tiers on each frame part being equal.

4. A textile machine as claimed in claim 1, and power drive means including mechanical transmission systems for driving all of the take-up units on each respective frame part at the same rotational speed for their respective bobbins.

5. A textile machine as claimed in claim 1, and a plate bearing a plurality of said take-up units and attached to at least one frame part.

6. A textile machine as claimed in claim 2, and a plate bearing a plurality of said take-up units and attached to at least one frame part.

7. A textile machine as claimed in claim 3, and a plate bearing a plurality of said take-up units and attached to at least one frame part.

8. A textile machine as claimed in claim 1, said first set of delivery rollers, said filament heating means and said filament texturizing means being mounted on said first frame part above the filament take-up units on said first frame part, filament guide means below respective sets of take-up units on each of said first, second and third frame parts to guide said filaments, after passage through said first set of rollers, said heating means, and said texturizing means to positions below the respective frame parts, and means for conducting respective filaments upwardly from the respective guide means to respective take-up units on respective frame parts.

9. A textile machine as claimed in claim 8, wherein the respective sets of take-up units include driven winder units arranged in tiers of horizontal rows on each of said frame parts, and the number of said tiers on each frame part being equal.

10. A textile machine as claimed in claim 8, wherein the respective sets of take-up units include driven winder units arranged in tiers of horizontal rows on each of said frame parts, and a plurality of said take-up units of said second and third frame parts being mounted on a plate attached to its respective second and third frame part.

* * * * *